US009111524B2

(12) United States Patent
Hoerich

(10) Patent No.: US 9,111,524 B2
(45) Date of Patent: Aug. 18, 2015

(54) SEAMLESS PLAYBACK OF SUCCESSIVE MULTIMEDIA FILES

(71) Applicant: Dolby International AB, Amsterdam Zuidoost (NL)

(72) Inventor: Holger Hoerich, Fürth (DE)

(73) Assignee: Dolby International AB, Amsterdam (NL)

( * ) Notice: Subject to any disclaimer, the term of this patent is extended or adjusted under 35 U.S.C. 154(b) by 385 days.

(21) Appl. No.: 13/688,682

(22) Filed: Nov. 29, 2012

(65) Prior Publication Data

US 2013/0159004 A1 Jun. 20, 2013

Related U.S. Application Data

(60) Provisional application No. 61/577,873, filed on Dec. 20, 2011.

(51) Int. Cl.
*G10L 19/00* (2013.01)
*G10L 19/16* (2013.01)

(52) U.S. Cl.
CPC ..... *G10L 19/00* (2013.01); *G10L 19/167* (2013.01)

(58) Field of Classification Search
CPC ..... G10L 19/022; G10L 19/20; G10L 19/18; G10L 19/24; G10L 19/167; G10L 19/005; G11B 2020/00021; G11B 2020/00028; G11B 2020/10546
USPC ..... 704/229, 500–504, 201, 209, 211; 375/240.26
See application file for complete search history.

(56) References Cited

U.S. PATENT DOCUMENTS

| | | | | |
|---|---|---|---|---|
| 5,924,064 | A * | 7/1999 | Helf | 704/229 |
| 6,353,173 | B1 | 3/2002 | D'Amato | |
| 6,721,710 | B1 | 4/2004 | Lueck | |
| 6,832,198 | B1 | 12/2004 | Nguyen | |
| 6,965,805 | B2 | 11/2005 | Hatanaka | |
| 6,996,327 | B1 | 2/2006 | Park | |
| 7,043,314 | B2 | 5/2006 | Hatanaka et al. | |

(Continued)

OTHER PUBLICATIONS

ISO/IEC 14496-12 (MPEG4 Part 12).

(Continued)

*Primary Examiner* — Huyen Vo

(57) ABSTRACT

The present document relates to methods and systems for encoding and decoding multimedia files. In particular, the present document relates to methods and systems for encoding and decoding a plurality of audio tracks for seamless playback of the plurality of audio tracks. A method for encoding an audio signal comprising a first and a directly following second audio track for seamless and individual playback of the first and second audio tracks is described. The first and second audio tracks comprise a first and second plurality of audio frames, respectively. The method comprises jointly encoding the audio signal using a frame based audio encoder, thereby yielding a continuous sequence of encoded frames; extracting a first plurality of encoded frames from the continuous sequence of encoded frames; extracting a second plurality of encoded frames from the continuous sequence of encoded frames; appending one or more rear extension frames to an end of the first plurality of encoded frames; and appending one or more front extension frames to the beginning of the second plurality of encoded frames.

20 Claims, 8 Drawing Sheets

(56) References Cited

U.S. PATENT DOCUMENTS

| | | | | |
|---|---|---|---|---|
| 7,149,159 | B2 | 12/2006 | Oomen et al. | |
| 7,187,842 | B2 | 3/2007 | Ninomiya | |
| 7,337,297 | B2 | 2/2008 | Chen | |
| 7,436,756 | B2 | 10/2008 | Bernsen | |
| 7,756,392 | B2 | 7/2010 | Ninomiya | |
| 7,769,477 | B2 | 8/2010 | Geyersberger | |
| 2004/0017757 | A1 | 1/2004 | Kaneaki | |
| 2009/0083047 | A1 | 3/2009 | Lindahl | |
| 2011/0150099 | A1* | 6/2011 | Owen | 375/240.26 |

OTHER PUBLICATIONS

ISO/IEC 14496-14:2003 MP4 format.
3G2 Format as specified in 3GPP TS 26.244.
3GPP2 file format as specified in 3GPP2 C.S0050-B version 1.0.
MPEG-4 part 3 ISO/IEC 14496-3:2009.

* cited by examiner

SEAMLESS PLAYBACK OF SUCCESSIVE MULTIMEDIA FILES

CROSS REFERENCE TO RELATED APPLICATIONS

This Application claims the benefit of priority related to, Provisional U.S. Patent Application No. 61/577,873 filed on 20 Dec. 2011 entitled "Seamless Playback of Successive Multimedia Files" by Holger Hoerich, hereby incorporated by reference in its entirety.

TECHNICAL FIELD

The present document relates to methods and systems for encoding and decoding multimedia files. In particular, the present document relates to methods and systems for encoding and decoding a plurality of audio tracks for seamless playback of the plurality of audio tracks.

BACKGROUND

It may be desirable to encode multimedia content representing an uninterrupted stream of audio content (i.e. an audio signal) into a series of successive files (i.e. a plurality of audio tracks). Furthermore, it may be beneficial to decode the successive audio tracks in sequential order such that the audio content is reproduced by a decoder with no interruptions (i.e., gaps or silence) at the boundaries between successive tracks. An uninterrupted stream of audio content could be, for example, a live musical performance consisting of a series of individual songs separated by periods of applause, crowd noise, and/or dialogue.

The present document addresses the above mentioned technical problem of encoding/decoding an audio signal in order to provide for a seamless (uninterrupted) playback of the plurality of audio tracks. The methods and systems described in the present document enable an individual playback of one or more of the plurality of audio tracks (regardless the particular order of the tracks during the individual playback), as well as a seamless playback of the plurality of audio tracks at low encoding noise at the track boundaries. Furthermore, the methods and systems described in the present document may be implemented at low computational complexity.

SUMMARY

According to an aspect, a method for encoding an audio signal comprising a first and a directly following second audio track is described. The method is directed at encoding the audio signal for seamless and/or individual playback of the first and second audio tracks. In other words, the encoded first and second audio tracks should be configured such that the first and second decoded audio tracks can be played back seamlessly (i.e. without gaps) and/or such that the first and second decoded audio tracks can be played back individually without distortions (notably at their respective beginning/end). The first and second audio tracks comprise a first and second plurality of audio frames, respectively. Each audio frame may comprise a pre-determined number of samples (e.g. 1024 samples) at a pre-determined sampling rate (e.g. 44.1 kHz).

The method for encoding may comprise jointly encoding the audio signal using a frame based audio encoder, thereby yielding a continuous sequence of encoded frames. In other words, the audio signal (comprising the first and directly succeeding second audio track) is encoded as a whole, which is in contrast to a separate encoding of the first and second audio tracks. By way of example, the frame based audio encoder may take into consideration one or more neighboring (adjacent) frames when encoding a particular audio frame. This is e.g. the case for frame based audio encoders which make use of an overlapped transform, such as the Modified Discrete Cosine Transform (MDCT), and/or which make use of a windowing of a group of adjacent frames (i.e. the application of a window function across a group of adjacent frames), when encoding the particular frame. For such frame based audio encoders, the joint encoding of the audio signal typically results in a different encoding result (notably at the boundary between the first and second audio track) compared to the separate encoding of the first and second audio tracks.

The method may further comprise extracting a first plurality of encoded frames from the continuous sequence of encoded frames, wherein the first plurality of encoded frames corresponds to the first plurality of audio frames. Typically, each frame of the audio signal is encoded into a corresponding encoded frame. By way of example, each frame of the audio signal may be transformed into the frequency domain (e.g. using a MDCT transform), thereby yielding a set of frequency coefficients for the respective audio frame. As indicated above, the transform may take in one or more neighboring adjacent frames. Nevertheless, each frame of the audio signal is transformed into a directly corresponding set of frequency coefficients (possibly taking into account adjacent frames). The set of frequency coefficients may be quantized and entropy (Huffman) encoded, thereby yielding the encoded data of the encoded frame corresponding to the particular audio frame. As such, typically the number of encoded frames of the first plurality of encoded frames corresponds to the number of frames of the first plurality of audio frames. Furthermore, each encoded frame of the first plurality of encoded frames typically comprises encoded data for a single corresponding frame of the first plurality of audio frames. In other words, there may be a one-to-one correspondence between the first plurality of encoded frames and the first plurality of audio frames.

In a similar manner, the method may comprise extracting a second plurality of encoded frames from the continuous sequence of encoded frames; wherein the second plurality of encoded frames corresponds to the second plurality of audio frames. The number of encoded frames of the second plurality of encoded frames usually corresponds to the number of frames of the second plurality of audio frames. Furthermore, each encoded frame of the second plurality of encoded frames typically comprises encoded data for a single corresponding frame of the second plurality of audio frames. In other words, there may be a one-to-one correspondence between the second plurality of encoded frames and the second plurality of audio frames. In view of the fact that the second audio track may directly follow the first audio track (without gap), the second plurality of encoded frames may directly follow the first plurality of encoded frames in the continuous sequence of encoded frames.

The method may comprise appending one or more rear extension frames to an end of the first plurality of encoded frames; wherein the one or more rear extension frames correspond to one or more frames from a beginning of the second plurality of encoded frames, thereby yielding a first encoded audio file. As such, the first encoded audio file may comprise the first plurality of encoded frames which is directly followed by one or more rear extension frames. The one or more rear extension frames preferably correspond to (e.g. are identical with) the one or more encoded frames at the very beginning of the second plurality of encoded frames. This means that the first encoded audio file may comprise one or more extension frames which overlap with the beginning of the second plurality of encoded frames.

Furthermore, the method may comprise appending one or more front extension frames to the beginning of the second plurality of encoded frames; wherein the one or more front extension frames correspond to one or more frames from the end of the first plurality of encoded frames, thereby yielding a second encoded audio file. As such, the second encoded audio file may comprise the second plurality of encoded frames which is directly preceded by one or more front extension frames. The one or more front extension frames preferably correspond to (e.g. are identical with) the one or more encoded frames at the very end of the first plurality of encoded frames. This means that the second encoded audio file may comprise one or more extension frames which overlap with the end of the first plurality of encoded frames.

The one or more rear extension frames may be two or more, three or more, or four or more rear extension frames; and/or the one or more front extension frames may be two or more, three or more, or four or more front extension frames. By extending the number of extension frames at the end/beginning of an encoded audio file, extended interrelations between neighboring encoded frames caused by the frame based audio encoder may be taken into account. This may be particularly relevant when decoding the first and/or second audio track individually.

The continuous sequence of encoded frames, the first encoded audio file and/or the second encoded audio file may be encoded in an ISO base media file format as specified in ISO/IEC 14496-12 (MPEG-4 Part 12) which is incorporated by reference. By way of example, the continuous sequence of encoded frames, the first encoded audio file and/or the second encoded audio file may be encoded in one of the following formats: an MP4 format (as specified in ISO/IEC 14496-14: 2003 which is incorporated by reference), a 3GP format (3GPP file format as specified in 3GPP TS 26.244 which is incorporated by references, a 3G2 format (3GPP2 file format as specified in 3GPP2 C.S0050-B Version 1.0 which is incorporated by reference, or a LATM format (Low-overhead MPEG-4 Audio Transport Multiplex format as specified in MPEG-4 Part 3 ISO/IEC 14496-3:2009 which is incorporated by reference).

In more general terms, the encoded frames of the sequence of encoded frames, of the first encoded audio file and/or of the second encoded audio file may have a variable bit length. This means that the length (measured in bits) of the encoded frames may change on a frame-by-frame basis. In particular, the length of an encoded frame may depend on the number of bits used by the encoding unit for encoding the corresponding time-domain audio frame. By using encoded frames with a flexible length (in contrast to a fixed encoded frame structure as used e.g. in the context of mp3), it can be ensured that each time-domain audio frame can be represented by a corresponding encoded frame (in a one-to-one relationship).

As indicated above, the frame based audio encoder may make use of an overlapped time-frequency transform overlapping a plurality of (neighboring) audio frames to yield an encoded frame. Alternatively or in addition, the frame based audio encoder may make use of a windowing operation across a plurality of (neighboring) audio frames. In general terms, the frame based audio encoder may process a plurality of neighboring audio frames of a particular audio frame to determine the encoded frame corresponding to the particular audio frame. By way of example, the frame based audio encoder may make use of a Modified Discrete Cosine Transform, a Modified Discrete Sine Transform or a Modified Complex Lapped Transform. In particular, the frame based audio encoder may comprise an Advanced Audio Coding (AAC) encoder.

The method may further comprise providing metadata indicative of the one or more rear extension frames for the first encoded audio file, and/or providing metadata indicative of the one or more front extension frames for the second encoded audio file. In particular, the method may comprise adding the metadata to the first and/or second audio file. Typically, the metadata is added into a metadata container of the file format of the first encoded audio file and/or the second encoded audio file. Examples for such a metadata containers are the Meta Box, the User Data Box, or a UUID Box of the ISO Media file format or any derivative thereof, like the MP4 File Format or the 3GP File Format. The metadata may indicate a number of rear extension frames and/or a number of front extension frames. Alternatively or in addition, the metadata may comprise an indication of the second encoded audio file as comprising the second audio track directly following the first audio track. For example the second encoded audio file may be referenced from the first encoded audio file by using unique identifiers or hashes that are part of the metadata of the second encoded audio file. Alternatively or in addition, the second encoded audio file may comprise a reference to the first encoded audio file. For example, this reference may be a unique identifier or a hash that is comprised in the metadata of the first encoded audio file.

According to a further aspect, a method for decoding a first and a second encoded audio file, representative of a first and a (directly following) second audio track, respectively, is described. The method for decoding may decode the first and second encoded audio files for enabling a seamless playback of the first and (directly following) second audio track.

The first and second encoded audio files may have been encoded using the method outlined above. In particular, the first encoded audio track may comprise a first plurality of encoded frames followed by one or more rear extension frames. The first plurality of encoded frames may correspond to a first plurality of audio frames of the first audio track. As indicated above, the number of encoded frames in the first plurality of encoded frames may be equal to the number of audio frames in the first plurality of audio frames. Furthermore, there may be a one-to-one correspondence between each of the encoded frames and a corresponding audio frame. In a similar manner, the second encoded audio track comprises a second plurality of encoded frames preceded by one or more front extension frames; wherein the second plurality of encoded frames corresponds to a second plurality of audio frames of the second audio track. As indicated above, the number of encoded frames in the second plurality of encoded frames may be equal to the number of audio frames in the second plurality of audio frames. Furthermore, there may be a one-to-one correspondence between the encoded frames and the corresponding audio frames.

The method for decoding may comprise determining that the one or more rear extension frames correspond to one or more frames from (at) a beginning of the second plurality of encoded frames. In particular, it may be determined that the one or more rear extension frames are identical with the one or more frames at the direct beginning of the second plurality of encoded frames. Furthermore, the method may comprise determining that the one or more front extension frames correspond to one or more frames from (at) an end of the first plurality of encoded frames. In particular, it may be determined that the one or more front extension frames are identical with the one or more frames at the direct end of the first plurality of encoded frames.

The method may proceed in concatenating the end of the first plurality of encoded frames with the beginning of the second plurality of encoded frames to form a continuous sequence of encoded frames. In other words, the method may ignore or suppress the front and/or rear extension frames from the first and/or second encoded audio files and thereby form the continuous sequence of encoded frames comprising the first plurality of encoded frames which is directly followed by the second plurality of encoded frames.

In addition, the method may comprise decoding the continuous sequence of encoded frames to yield a joint decoded audio signal comprising the first plurality of audio frames directly followed by the second plurality of audio frames. The decoding may be performed on a frame-by-frame basis, i.e. each of the encoded frames of the continuous sequence of encoded frames may be decoded into a directly corresponding audio frame of the first or second plurality of audio frames. In particular, each encoded frame may comprise an encoded set of frequency coefficients which may be transformed (e.g. using an overlapped transform such as the inverse MDCT) to yield the corresponding frame of audio samples.

The one or more rear/front extension frames may be identified using metadata. As such, determining that the one or more rear extension frames correspond to one or more frames from (at) the beginning of the second plurality of encoded frames may comprise extracting metadata associated with the first encoded audio file indicative of a number of rear extension frames. The metadata may be extracted from a metadata container comprised within the first encoded audio file. In a similar manner, determining that the one or more front extension frames correspond to one or more frames from (at) the end of the first plurality of encoded frames may comprise extracting metadata associated with the second encoded audio file indicative of a number of front extension frames. The metadata may be extracted from a metadata container comprised within the second encoded audio file.

Alternatively or in addition, a decoder may be configured to determine the one or more rear/front extension frames by analyzing the first and/or second audio files. As such, determining that the one or more rear extension frames correspond to one or more frames from (at) the beginning of the second plurality of encoded frames may comprise comparing one or more frames at an end of the first encoded audio file with the one or more frames from the beginning of the second plurality of encoded frames. In a similar manner, determining that the one or more front extension frames correspond to one or more frames from (at) the end of the first plurality of encoded frames may comprise comparing one or more frames at a beginning of the second encoded audio file with the one or more frames from the end of the first plurality of encoded frames.

The method for decoding may further comprise, prior to determining that the one or more front extension frames correspond to one or more frames from (at) the end of the first plurality of encoded frames, identifying the second audio track based on metadata comprised within the first encoded audio track. In other words, a decoder may be configured to identify the second encoded audio file which comprises the second audio track (which directly follows the first audio track) from metadata associated with the first encoded audio file. Alternatively or in addition, a decoder may be configured to identify the first audio track from metadata associated with the second audio track. As such, the decoder may be configured to automatically build a sequence of audio tracks for seamless playback.

According to another aspect, an audio encoder configured to encode an audio signal comprising a first and a directly following second audio track is described. The audio encoder may be configured to perform the encoding methods described in the present document. In particular, the audio encoder may be configured to encode the audio signal to enable seamless and individual playback of the first and second audio tracks. As outlined above, the first and second audio tracks comprise a first and second plurality of audio frames, respectively.

The audio encoder may comprise an encoding unit configured to jointly encode the audio signal using a frame based audio encoder, thereby yielding a continuous sequence of encoded frames. Furthermore, the audio encoder may comprise an extraction unit configured to extract a first plurality of encoded frames from the continuous sequence of encoded frames; wherein the first plurality of encoded frames corresponds to the first plurality of audio frames (e.g. on a one-to-one basis); and/or configured to extract a second plurality of encoded frames from the continuous sequence of encoded frames; wherein the second plurality of encoded frames corresponds to the second plurality of audio frames (e.g. on a one-to-one basis); wherein the second plurality of encoded frames directly follows the first plurality of encoded frames in the continuous sequence of encoded frames. In addition, the audio encoder may comprise an adding unit configured to append one or more rear extension frames to an end of the first plurality of encoded frames; wherein the one or more rear extension frames correspond to one or more frames from a beginning of the second plurality of encoded frames, thereby yielding a first encoded audio file; and/or configured to append one or more front extension frames to the beginning of the second plurality of encoded frames; wherein the one or more front extension frames correspond to one or more frames from the end of the first plurality of encoded frames, thereby yielding a second encoded audio file.

According to a further aspect, an audio decoder configured to decode a first and a second encoded audio file, representative of a first and a second audio track, respectively, is described. The audio decoder may e.g. be part of a media player configured to playback the first and/or second audio track. The audio decoder may be configured to perform the decoding methods described in the present document. In particular, the audio decoder may enable the seamless playback of the first and second audio tracks. As indicated above, the first encoded audio track may comprise a first plurality of encoded frames followed by one or more rear extension frames. Typically, the first plurality of encoded frames corresponds to a first plurality of audio frames of the first audio track (e.g. on a one-to-one basis). Furthermore, the second encoded audio track may comprise a second plurality of encoded frames preceded by one or more front extension frames. Typically, the second plurality of encoded frames corresponds to a second plurality of audio frames of the second audio track (e.g. on a one-to-one basis).

The audio decoder may comprise a detection unit configured to determine that the one or more rear extension frames correspond to one or more frames from a beginning of the second plurality of encoded frames; and/or configured to determine that the one or more front extension frames correspond to one or more frames from an end of the first plurality of encoded frames. Furthermore, the decoder may comprise a merging unit configured to concatenate the end of the first plurality of encoded frames with the beginning of the second plurality of encoded frames to form a continuous sequence of encoded frames. In addition, the decoder may comprise a decoding unit configured to decode the continuous sequence of encoded frames to yield a joint decoded audio signal comprising the first plurality of audio frames directly followed by the second plurality of audio frames.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on a computing device.

According to a further aspect, a computer program product is described. The computer program may comprise executable instructions for performing the method steps outlined in the present document when executed on a computer.

It should be noted that the methods and systems including its preferred embodiments as outlined in the present document may be used stand-alone or in combination with the other methods and systems disclosed in this document. Furthermore, all aspects of the methods and systems outlined in the present document may be arbitrarily combined. In particular, the features of the claims may be combined with one another in an arbitrary manner.

SHORT DESCRIPTION OF THE DRAWINGS

The invention is explained below in an exemplary manner with reference to the accompanying drawings, wherein FIG. 1*a* illustrates a block diagram of an example spectral band replication based audio codec, namely high efficiency advanced audio coding (HE-AAC);

FIG. 1*b* illustrates a block diagram of an example advanced audio coding (AAC) encoder;

DETAILED DESCRIPTION

Figure 1A:
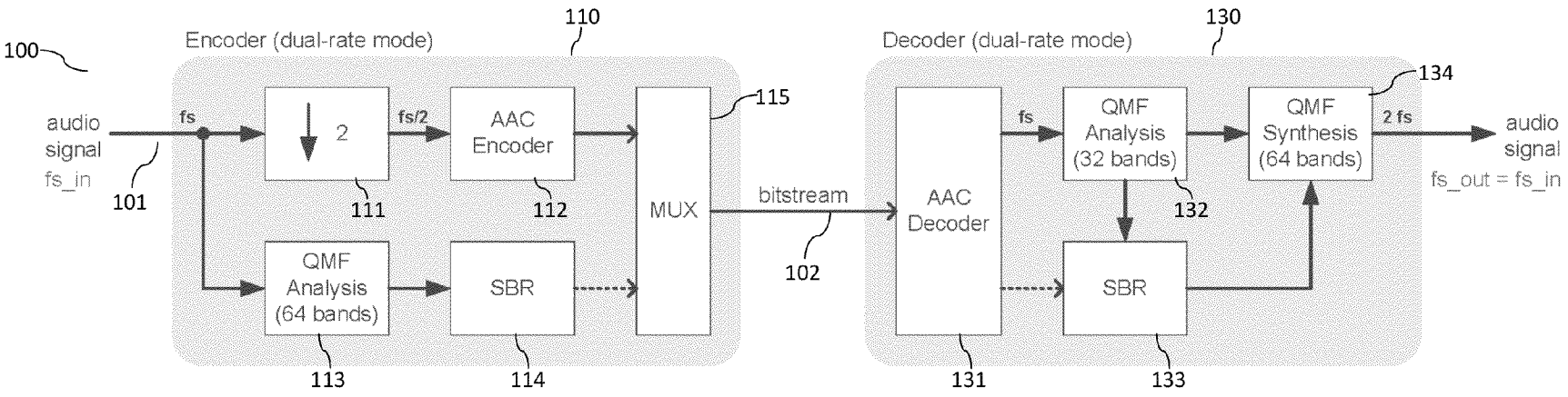

FIG. 1*a* illustrates an example SBR based audio codec 100 used in HE-AAC version 1 and HE-AAC version 2 (i.e. HE-AAC comprising parametric stereo (PS) encoding/decoding of stereo signals). In particular, FIG. 1 shows a block diagram of an HE-AAC codec 100 operating in the so called dual-rate mode, i.e. in a mode where a core encoder 112 in an encoder 110 works at half the sampling rate than a SBR (Spectral Band Replication) encoder 114. At the input of the encoder 110, an audio signal 101 at the input sampling rate fs=fs_in is provided. An audio signal 101 is downsampled by a factor two in a downsampling unit 111 in order to provide the low frequency component of the audio signal 101. Typically, the downsampling unit 111 comprises a low pass filter in order to remove the high frequency component prior to downsampling (thereby avoiding aliasing). The downsampling unit 111 provides a low frequency component at a reduced sampling rate fs/2=fs_in/2. The low frequency component is encoded by the core encoder 112 (e.g. an AAC encoder) to provide an encoded bitstream of the low frequency component.

The high frequency component of the audio signal is encoded using SBR parameters. For this purpose, the audio signal 101 is analyzed using an analysis filter bank 113 (e.g. a quadrature mirror filter bank (QMF) having e.g. 64 frequency bands). As a result, a plurality of subband signals of the audio signal is obtained, wherein at each time instant t (or at each sample k), the plurality of subband signals provides an indication of the spectrum of the audio signal 101 at this time instant t. The plurality of subband signals is provided to the SBR encoder 114. The SBR encoder 114 determines a plurality of SBR parameters, wherein the plurality of SBR parameters enables the reconstruction of the high frequency component of the audio signal from the (reconstructed) low frequency component at a corresponding decoder 130. The SBR encoder 114 typically determines the plurality of SBR parameters such that a reconstructed high frequency component that is determined based on the plurality of SBR parameters and the (reconstructed) low frequency component approximates the original high frequency component. For this purpose, the SBR encoder 114 may make use of an error minimization criterion (e.g. a mean square error criterion) based on the original high frequency component and the reconstructed high frequency component.

The plurality of SBR parameters and the encoded bitstream of the low frequency component are joined within a multiplexer 115 to provide an overall bitstream 102, which may be stored or which may be transmitted. The overall bitstream 102 typically also comprises information regarding SBR encoder settings, which were used by the SBR encoder 114 to determine the plurality of SBR parameters.

The overall bitstream 102 may be encoded in various formats, such as an MP4 format, a 3GP format, a 3G2 format, or a LATM format. These formats typically provide metadata containers in order to signal metadata to a corresponding decoder. By way of example, the MP4 format is a multimedia container format standard specified as a part of MPEG-4 (see standardization document ISO/IEC 14496-14:2003 which is incorporated by reference). The MP4 format is an instance of the MPEG-4 Part 12 format (see standardization document ISO/IEC 14496-12:2004 which is incorporated by reference). The MP4 format provides an "extension_payload( )" element which can be used to encode metadata into the overall bitstream 102. The metadata may be used by the corresponding decoder 130 to provide particular services or features during playback. In the present document, it is proposed to insert metadata into the overall bitstream 102, wherein the metadata enables the decoder 130 to provide seamless playback of a plurality of sequential audio tracks.

The corresponding decoder 130 may generate an uncompressed audio signal at the sampling rate fs_out=fs_in from the overall bitstream 102. A core decoder 131 separates the SBR parameters from the encoded bitstream of the low frequency component. Furthermore, the core decoder 131 (e.g. an AAC decoder) decodes the encoded bitstream of the low frequency component to provide a time domain signal of the reconstructed low frequency component at the internal sampling rate fs of the decoder 130. The reconstructed low frequency component is analyzed using an analysis filter bank 132.

The analysis filter bank 132 (e.g. a quadrature mirror filter bank having e.g. 32 frequency bands) typically has only half the number of frequency bands compared to the analysis filter bank 113 used at the encoder 110. This is due to the fact that only the reconstructed low frequency component and not the entire audio signal has to be analyzed. The resulting plurality of subband signals of the reconstructed low frequency component are used in a SBR decoder 133 in conjunction with the received SBR parameters to generate a plurality of subband signals of the reconstructed high frequency component. Subsequently, a synthesis filter bank 134 (e.g. a quadrature mirror filter bank of e.g. 64 frequency bands) is used to provide the reconstructed audio signal in the time domain. Typically, the synthesis filter bank 134 has a number of frequency bands which is double the number of frequency bands of the analysis filter bank 132. The plurality of subband signals of the reconstructed low frequency component may be fed to the lower half of the frequency bands of the synthesis filter bank 134, and the plurality of subband signals of the reconstructed high frequency component may be fed to the higher half of the frequency bands of the synthesis filter bank 134. The reconstructed audio signal at the output of the synthesis filter bank 134 has an internal sampling rate of 2fs which corresponds to the signal sampling rates fs_out=fs_in.

Figure 1B:
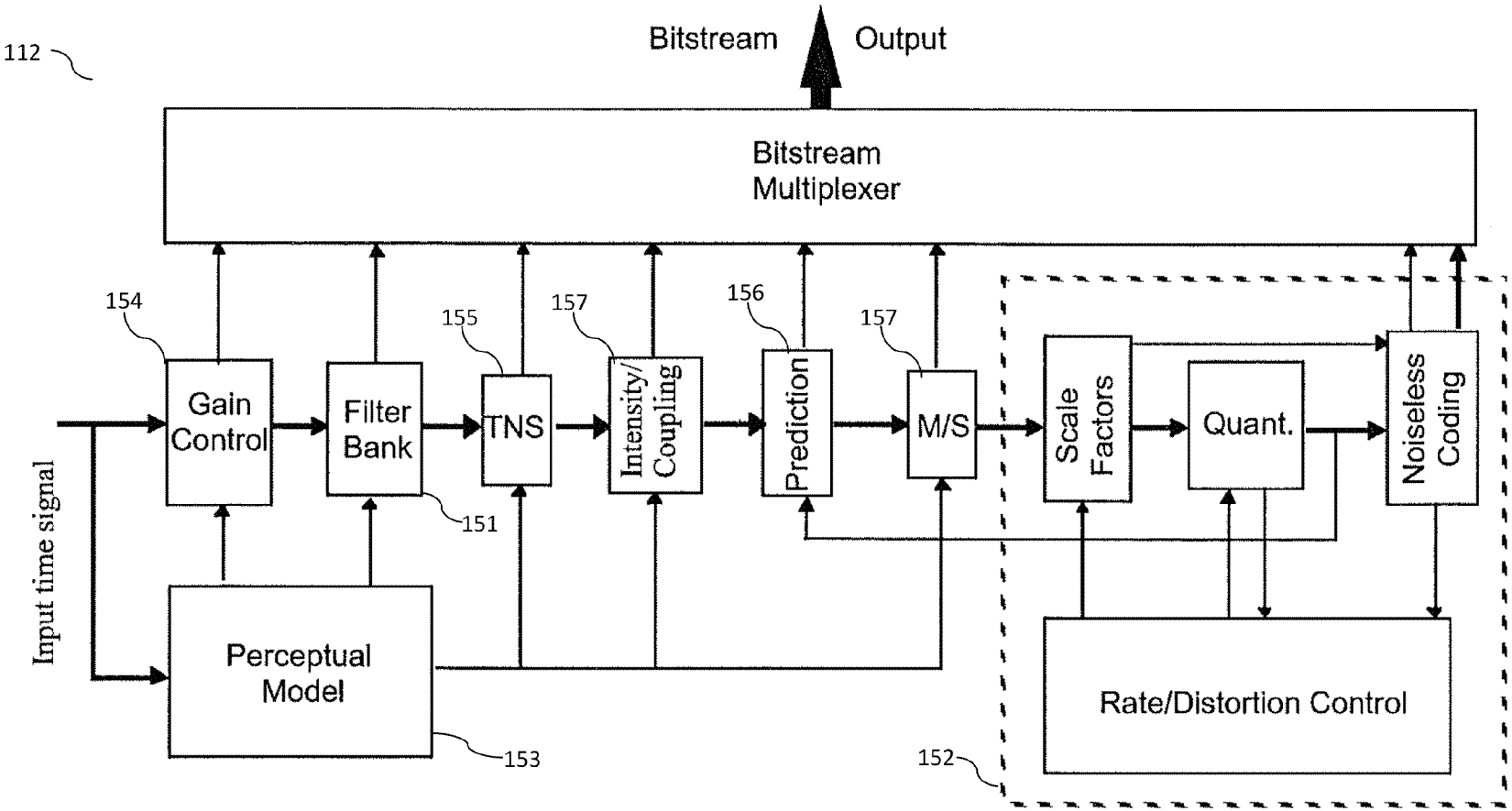

In the following, the AAC core encoder 112 is described in further detail. It should be noted that the core encoder 112 may be used standalone (without the use of the SBR encoding) to provide an encoded bitstream 102. An example block diagram of an AAC encoder 112 is shown in FIG. 1*b*. The AAC core encoder 112 typically breaks an audio signal 101 (or the low frequency component thereof) into a sequence of segments, called frames. A time domain filter, called a window, provides smooth transitions from frame to frame by modifying the data in these frames. The AAC core encoder 112 is adapted to dynamically switch between the encoding of a frame at two different time-frequency resolutions: a first resolution, referred to as a long-block, encoding the entire frame of M=1028 samples and a second resolution, referred to as a short-block, encoding a plurality of segments of M=128 samples of the frame. As such, the AAC core encoder 112 is adapted to encode audio signals that vacillate between tonal (steady-state, harmonically rich complex spectra signals) (using a long-block) and impulsive (transient signals) (using a sequence of eight short-blocks).

Figure 2:
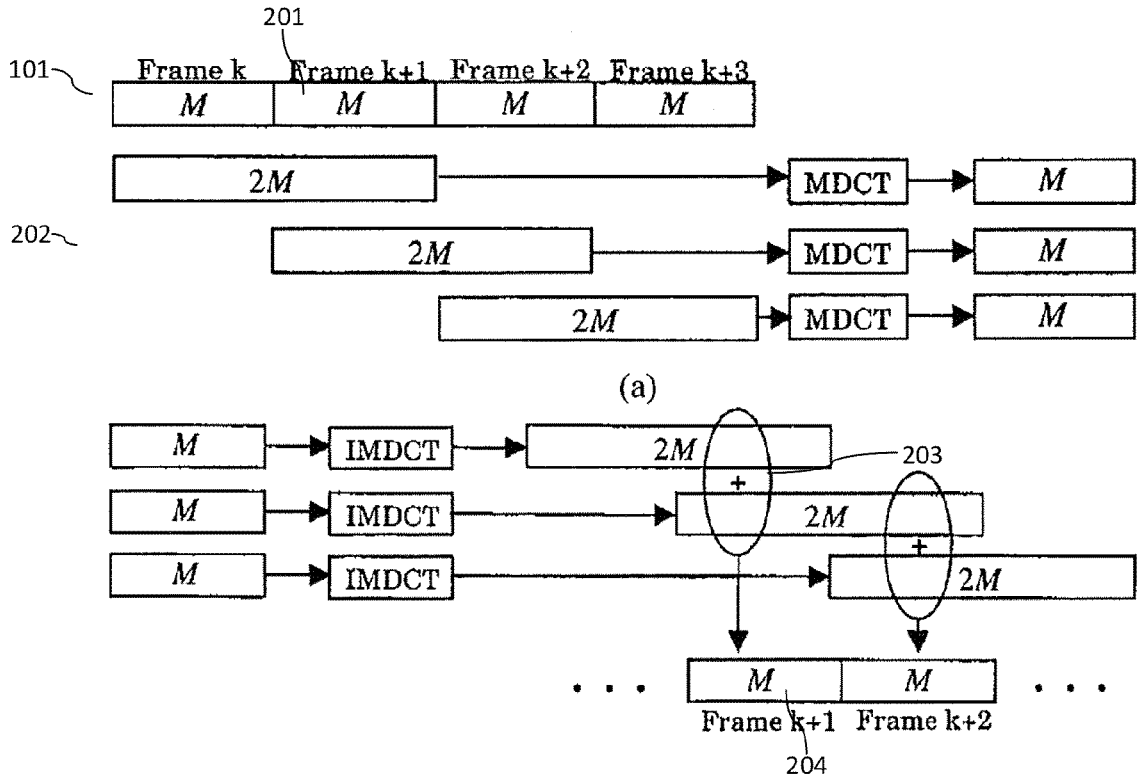
FIG. 2 shows schematically the overlapping of a plurality of frames of an audio signal in the context of a modified discrete cosine transform.

Each block of samples (i.e. a short-block or a long-block) is converted into the frequency domain using a Modified Discrete Cosine Transform (MDCT). In order to circumvent the problem of spectral leakage, which typically occurs in the context of block-based (also referred to as frame-based) time frequency transformations, MDCT makes use of overlapping windows, i.e. MDCT is an example of a so-called overlapped transform. This is illustrated in FIG. 2 for the case of a long-block, i.e. for the case where the entire frame is transformed. FIG. 2 shows an audio signal 101 comprising a sequence of frames 201. In the illustrated example, each frame 201 comprises M samples of the audio signals 101. Instead of applying the transform to only a single frame, the overlapping MDCT transforms two neighboring frames in an overlapping manner, as illustrated by the sequence 202. To further smoothen the transition between sequential frames, a window function w[k] of length 2M is additionally applied. It should be noted that because the window w[k] is applied twice, i.e. in the context of the transform at the encoder and in the context of the inverse transform at the decoder, the window function w[k] should fulfill the Princen-Bradley condition. As a result of the windowing and the transform, a sequence of sets of frequency coefficients of length M is obtained. At the corresponding AAC decoder 131, the inverse MDCT is applied to the sequence of sets of frequency coefficients, thereby yielding a sequence of frames of time-domain samples with a length of 2M. Using an overlap and add operation 203 (under consideration of the window function w[k]) as illustrated in FIG. 2, the frames of decoded samples 204 of length M are obtained.

FIG. 1*b* illustrates further details of an example AAC (core) encoder 112. The encoder 112 comprises a filter bank 151 which applies an MDCT transform to a frame of samples of the audio signal 101. As outlined above, the MDCT transform is an overlapped transform and typically processes the samples of two frames of the audio signal 101 to provide a set of frequency coefficients. The set of frequency coefficients are submitted to quantization and entropy encoding in unit 152. The quantization & encoding unit 152 ensures that an optimized tradeoff between target bit-rate and quantization noise is achieved. Additional components of an AAC encoder 112 are a perceptual model 153 which is used (among others) to determine signal dependent masking thresholds which are applied during quantization and encoding. Furthermore, the AAC encoder 112 may comprise a gain control unit 154 which applies a global adjustment gain to each bock of the audio signal 101. By doing this, the dynamic range of the AAC encoder 112 can be increased. In addition, temporal noise shaping (TNS) 155, backward prediction 156, and joint stereo coding 157 (e.g. mid/side signal encoding) may be applied.

As outlined above, the MDCT transform typically transforms the samples of two neighboring frames into the frequency domain, in order to determine a set of M frequency coefficients. Typically, this requires the initialization of the encoder at the beginning of an audio signal. By way of example, a frame of samples (e.g. samples of silence) may be inserted at the beginning of the audio signal, in order to ensure that the encoder 112 can correctly encode the first frame of the audio signal 101. In a similar manner, a frame of samples (e.g. samples of silence) may be required at the end of the audio signal 101. Such an additional frame at the end of the audio signal 101 may be required to ensure a correct encoding of the terminal frame of the audio signal 101. This can be seen in FIG. 2, where the encoding of the frame k+1 (reference numeral 201) makes use of the samples of the frame k. If the frame k+1 were the first frame of the audio signal 101, then a frame of lead-in samples (e.g. samples of silence) would need to be inserted, in order to transform frame k+1 into the frequency domain. In a similar manner, if the frame k+1 were the last frame of the audio signal 101, then the decoder 131 would need to provide lead-out samples at the end of the audio signal 101 in order to ensure a correct operation of the overlap and add 203. This means that a block of lead-out samples (e.g. samples of silence) would need to be added as a frame k+2 to the end of the audio signal 101.

Figure 3:
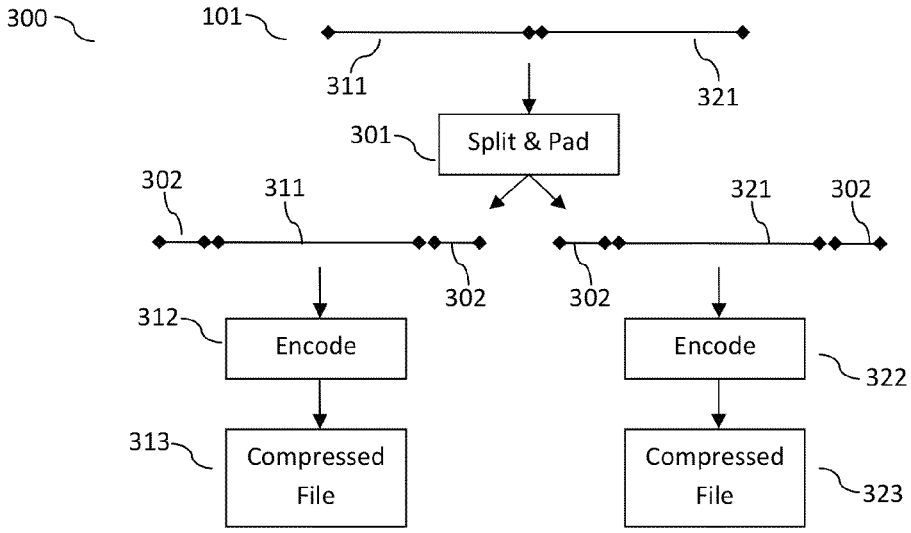
FIG. 3 shows an example flowchart of the encoding of a plurality of sequential audio tracks of an audio signal.

As outlined in the introductory section, the present document is directed at the encoding and decoding of a plurality of audio tracks of an audio signal which allows for a seamless playback of the plurality of audio tracks. FIG. 3 illustrates schematically a possible scheme 300 for encoding the plurality of audio tracks 311, 321 of an audio signal 101. The audio signal 101 may be split up into the plurality of audio tracks 311, 321 using a splitting unit 301. Furthermore, the splitting unit 301 may pad silence to the beginning and/or the end of each of the plurality of audio tracks 311, 321 in order to ensure an undistorted encoding of the plurality of audio tracks 311, 321. This is illustrated in FIG. 3 by means of the additional (silence) samples 302 preceding and/or following the plurality of audio tracks 311, 321. Subsequently each of the plurality of audio tracks 311, 321 is encoded using a respective instance of an audio encoding unit 312, 322 (e.g. the audio encoder 110, 112 illustrated in FIGS. 1*a* and 1*b*). As a result, a plurality of compressed files or bitstreams 313, 323 is obtained for each of the plurality of audio tracks 311, 321. These compressed files 313, 323 comprise data representative of one or more frames of silence at the beginning and/or the end of the respective audio tracks 311, 321. This allows the individual playback of the audio tracks 311, 321 by a media player comprising a corresponding decoder.

It should be noted that alternatively to adding silence to the beginning and/or end of an audio track 311, 321, one or more frames of the beginning of a succeeding audio track 321 may be added to the end of a preceding audio track 311, and vice versa. This will lead to additional frames at the end and/or the beginning of an audio track 311, 321 which can be taken into account during the encoding process 300. As such, redundant frames 302 are added to the end of a first audio track 311 and/or to the beginning of a succeeding second audio track 321. This leads to redundant encoding in the first encoding unit instance 312 and in the second encoding unit instance 322. In other words, the encoding of redundant lead-in/lead-out frames 302 leads to an increased computational complexity. Furthermore, it should be noted that due to the different respective states of the encoding unit instances 312, 322, the redundant encoded data in the compressed files 313, 323 of two successive tracks 311, 321 may not be identical. In particular, this may be due to the state of the bit reservoir (used in the quantization and encoding unit 152) at the end of the first track 311 typically differs from the state of the bit reservoir at the beginning of the next track 321. This means that the compressed data in the first compressed file 313 representative of a redundant frame 302 at the end of the first track 311 typically differs from the compressed data in the second compressed file 323 representative of the redundant frame 302 at the end of the second succeeding track 321.

Figure 6:
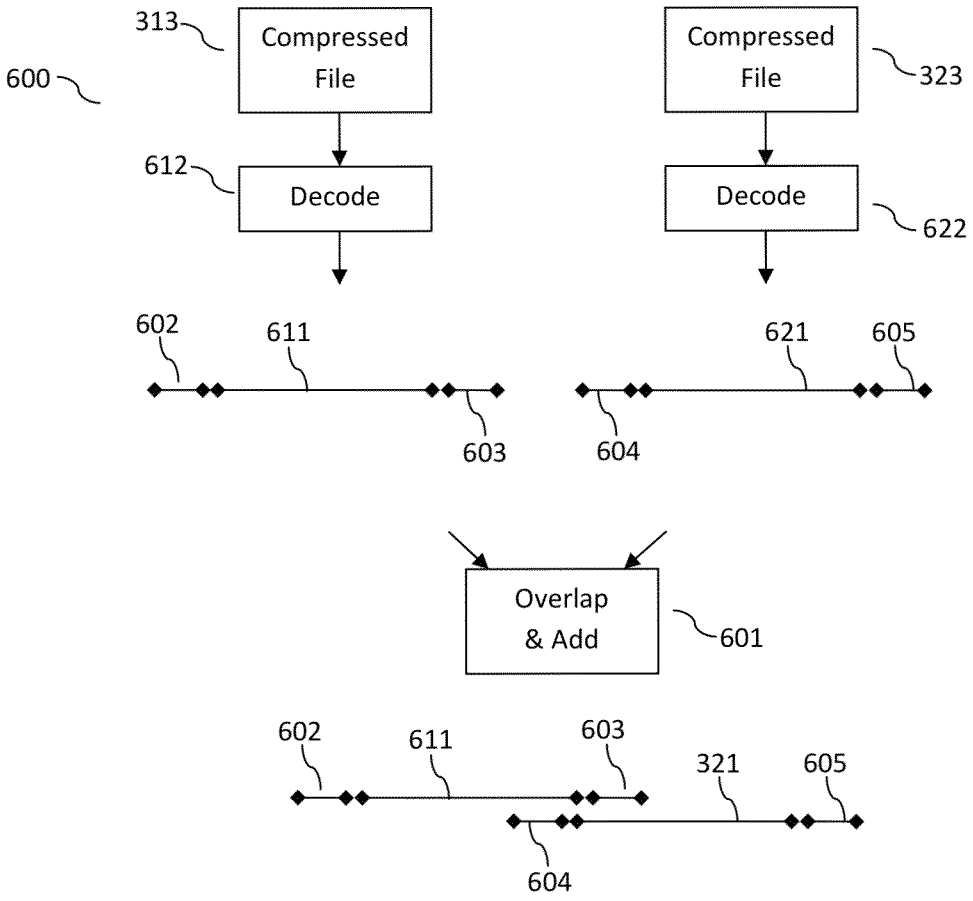
FIG. 6 shows an example flowchart of a decoding scheme for decoding a plurality of audio tracks for seamless playback.

A possible scheme 600 for decoding a sequence of audio tracks 311, 321 which have been encoded according to the scheme 300 outlined in FIG. 3 is illustrated in FIG. 6. The scheme 600 may be used to provide a seamless or gapless playback of the sequence of audio tracks 311, 321. For this purpose, the sequence of compressed files 313, 323 is decoded using respective decoding unit instances 612, 622. As a result, a sequence of decoded audio tracks 611, 621 is obtained. The audio tracks 611, 621 comprise one or more lead-in/lead-out frames 602, 603, 604, 605 of decoded silence (or of decoded redundant blocks) at their beginning and/or their end. It should be noted, however, that in view of the quantization at the corresponding encoding unit 312, 322, the one or more frames 602, 603, 604, 605 of decoded silence (or of decoded redundant blocks) may comprise quantization noise (e.g. as a result of a dithering of the sample value zero and/or as a result of pre/post echoes).

In order to provide for a gapless (uninterrupted) playback, the scheme 600 makes use of an overlap and add unit 601, which overlaps succeeding audio tracks 611, 621 such that the one or more lead-out frames 603 at the end of the first audio track 611 overlap with one or more frames (at the beginning) of the succeeding second audio track 621, and/or such that the one or more lead-in frames 604 at the beginning of the second audio track 621 overlap with one or more frames (at the end) of the preceding first audio track 611. During playback, the overlapped samples are added, thereby adding the samples of the one or more lead-out frames 603 at the end of the first audio track 611 to samples at the beginning of the second audio track 621, and/or adding the samples of the one or more lead-in frames 604 at the beginning of the second audio track 621 to samples at the end of the first audio track 611. This leads to a smooth transition between the first and second audio tracks 611, 621. However, as a result of the quantization noise comprised within the one or more lead-in/lead-out frames 603, 604 (referred to in general as extension frames 603, 604) this may lead to an increased amount of noise during playback.

Overall, it should be noted that the encoding 300 and decoding 600 schemes makes use of extended time-domain data at the beginning and/or end of the audio tracks of a sequence of audio tracks. The extended time-domain data may be silence or redundant data from a preceding/succeeding audio track. The use of extended time-domain data leads to increased computational complexity at the encoder and at the decoder. Furthermore, the extended time-domain data may lead to increased noise at the track borders during gapless playback.

Figure 4:
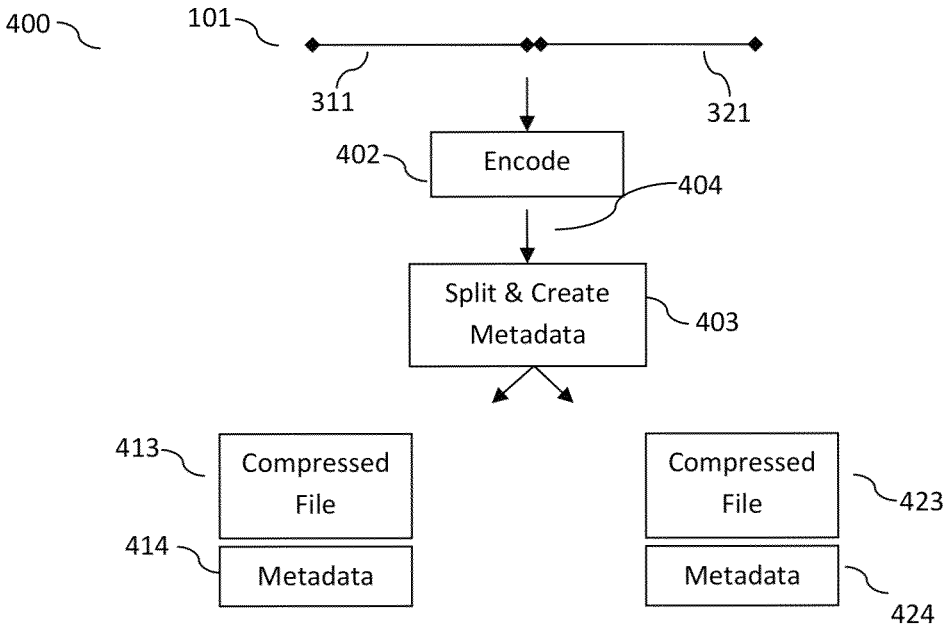
FIG. 4 shows an example flowchart of another encoding scheme for encoding a plurality of sequential audio tracks.
Figure 5:
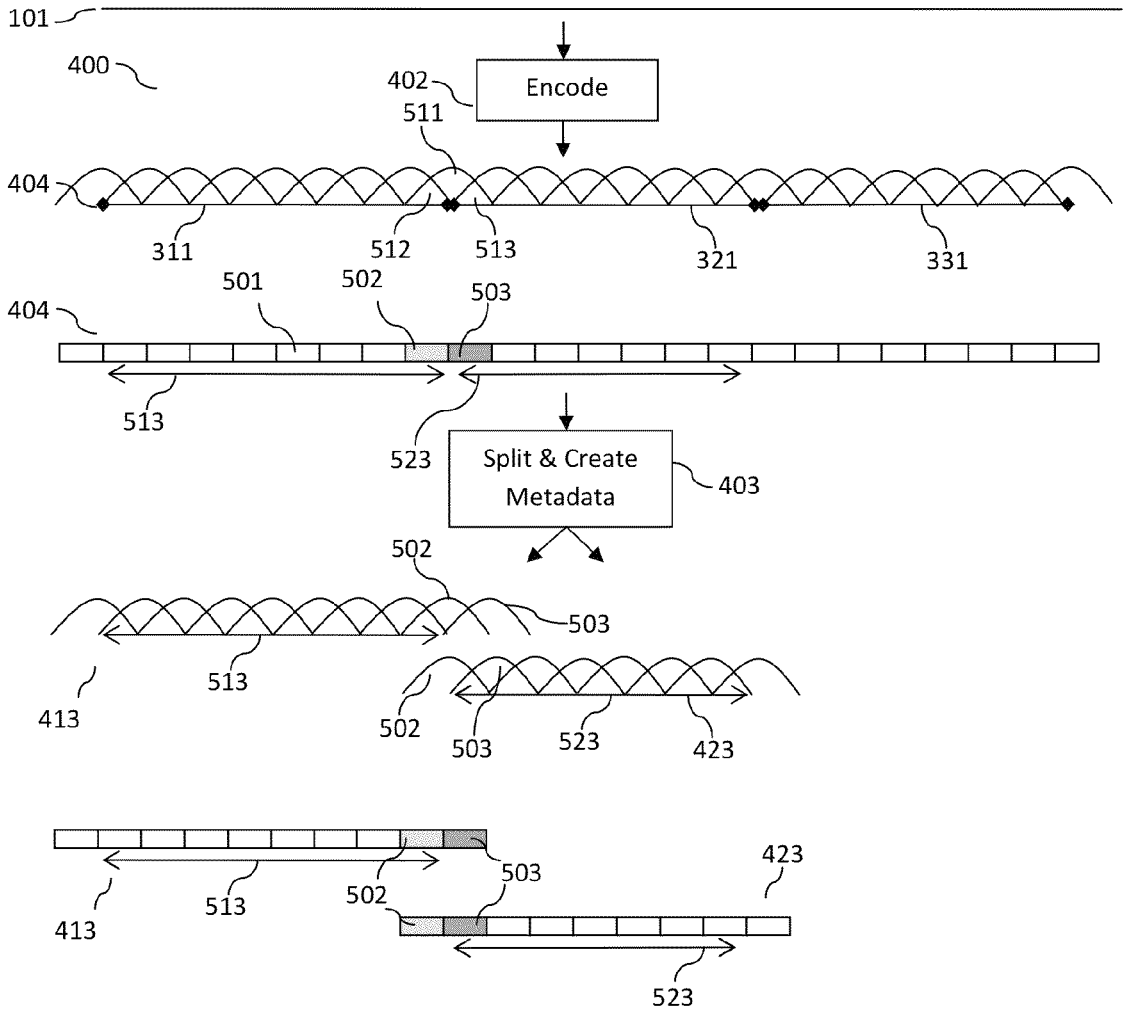
FIG. 5 illustrates the encoding scheme of FIG. 4 in further detail.

FIGS. 4 and 5 illustrate an alternative encoding scheme 400 which addresses the above mentioned shortcomings of the encoding 300 and decoding 600 schemes described in FIGS. 3 and 6, respectively. In the scheme 400, the audio signal 101 comprising the sequence of audio tracks 311, 321 is encoded in its entirety using a single instance of an encoding unit 402. In other words, the scheme 400 encodes the sequence of audio tracks 311, 321 as a single combined audio signal 101. This provides a single compressed file or bitstream 404 which may be split into a plurality of components (i.e. compressed files or bitstreams) 413, 423 corresponding to the plurality of audio tracks 311, 321 using the splitting unit 403. In addition to splitting up the single compressed file 404 into a plurality of compressed files 413, 423, the splitting unit 403 may generate metadata which is indicative of the neighboring compressed file(s) 423 of a compressed file 413. In particular, the metadata of a first compressed file 413 may comprise an indication for identifying the compressed file 423 of the directly succeeding audio track 321 and/or for identifying the compressed file of a directly preceding audio track. The metadata 414, 424 is typically encoded directly within the corresponding compressed files (or bitstreams) 413, 423 using the metadata container provided by the respective format of the encoded bitstream 102.

FIG. 5 illustrates the encoding scheme 400 of FIG. 4 in more detail. As outlined above, the audio signal 101 is encoded using the encoding unit 402 to provide a compressed file 404. The compressed file 404 comprises a sequence of frames 501 of compressed data. A frame 501 of compressed data is typically interrelated with a plurality of frames of samples of the original audio signal 101, e.g. due to the overlap characteristic of the MDCT transform used in the encoding unit 402. This is illustrated by the windows 511 which overlap with a plurality of frames 512, 513. In order to ensure a correct playback of each individual audio track 311, 321, 331, it is proposed to split the single compressed file 404 into a sequence of compressed files 413, 423 such that one or more frames 502 of compressed data (in short "compressed frames") from the end of the first sequence of compressed frames 513 corresponding to the first audio track 311 is appended to the beginning of a succeeding second sequence of compressed frames 523, and/or such that one or more compressed frames 503 from the beginning of the second sequence of compressed frames 523 corresponding to the second audio track 321 is appended to the end of the preceding first sequence of compressed frames 513. As a result, the first compressed file 413 and the second compressed file 423 comprise identical (i.e. redundant) compressed frames 502, 503 at their end and beginning, respectively. The metadata 414 comprised within the compressed file 413 may comprise an indication of the number of redundant compressed frames 502, 503 at the beginning and/or end of the compressed file 413, thereby enabling a corresponding decoder to take into account (e.g. to remove) some or all of the redundant frames 502, 503 during a seamless playback of the sequence of audio tracks 311, 321 based on the compressed files 413, 423 and/or during an individual playback of the audio tracks 311, 321 based on the compressed files 413, 423.

As outlined above, the redundant data is appended to the end and/or beginning of a compressed file 413, 423 in the compressed domain. This means that the encoded data is encoded only once and then duplicated within the splitting unit 403. Consequently, the computational complexity for encoding the sequence of audio tracks 311, 321 in view of a seamless playback is reduced compared to the encoding scheme 300 described in the context of FIG. 3. Furthermore, it should be noted that the compressed (redundant) data which is appended to the end of a first compressed file 413 is the same as the compressed data which is appended to the beginning of a succeeding second compressed file 423. This identity of redundant data simplifies the handling of the redundant data during playback, as will be outlined in the following.

Figure 7:
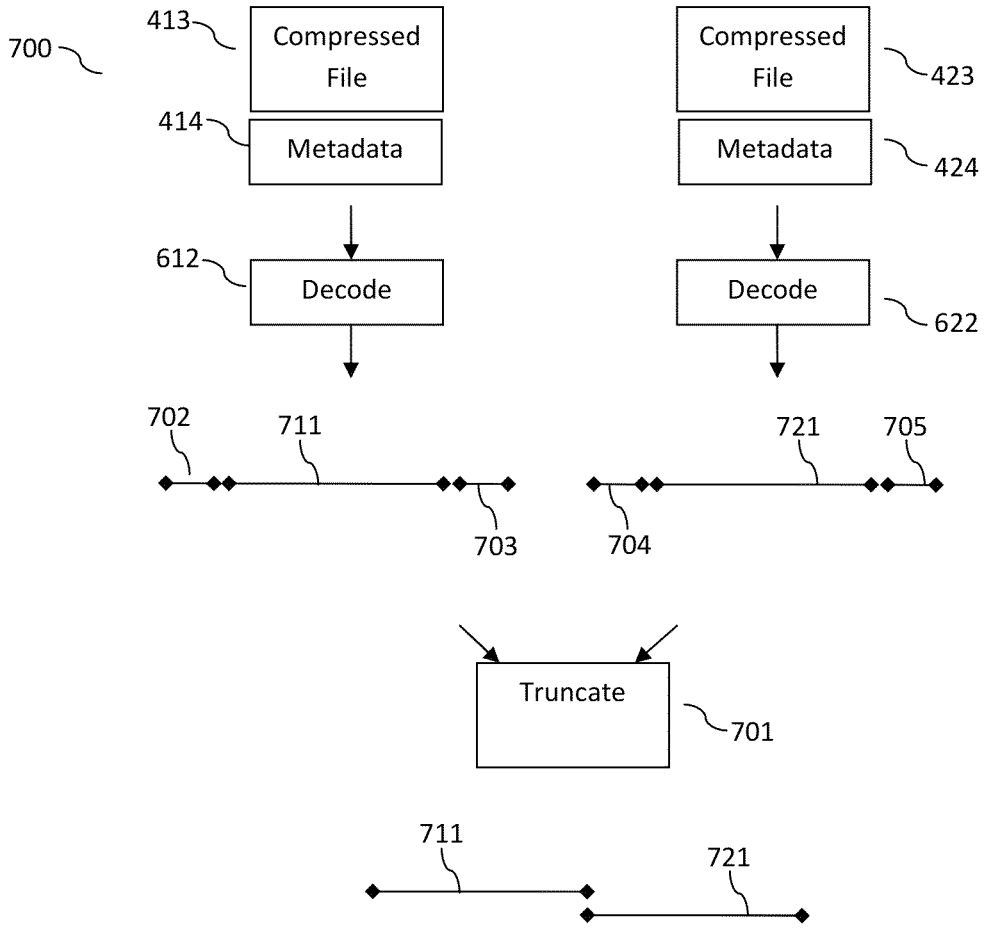
FIG. 7 shows an example flowchart of another decoding scheme for decoding a plurality of audio tracks for seamless playback.

FIG. 7 illustrates an example decoding scheme 700 for seamless playback of a sequence of compressed files 413, 423 associated with a sequence of audio tracks 311, 321. The decoding scheme 700 may make use of a plurality of instances of a conventional decoding unit 612, 622 to decode the corresponding compressed files 413, 423, thereby yielding a sequence of decoded audio tracks 711, 721. In view of the redundant compressed frames 502, 503 comprised within the compressed files 413, 423, a decoded audio track 711, 721 comprises a lead-in section 702, 704 and/or a lead-out section 703, 705 at the beginning and/or at the end of the decoded audio track 711, 721. The length of the lead-in/lead-out sections may be known from the metadata 414, 424 provided within the corresponding compressed file 413, 423.

In view of the fact that a compressed frame 502 at the end of the first sequence of compressed frames 513 (corresponding to the first audio track 311) was decoded using the correct succeeding frame 503 (comprised within the first compressed file 413), and/or in view of the fact that a compressed frame 503 at the beginning of the second sequence of compressed frames 523 (corresponding to the second audio track 321) was decoded using the correct preceding frame 502 (comprised within the second compressed file 423), a seamless playback of the first and second decoded audio tracks 711, 721 can be achieved by truncating the lead-out section 703 of the first decoded audio track 711 and the lead-in section 704 of the second decoded audio track 721. In other words, in view of the fact that the sequence of audio tracks 311, 321 was encoded 500 seamlessly using a single instance of the encoding unit 402 and in view of the fact that redundant lead-in/lead-out data was appended in the compressed domain, the decoded time-domain lead-in/lead-out frames can be truncated to provide a seamless playback of the decoded audio tracks 711, 721. The truncating of the lead-out/lead-in sections may be performed in a truncating unit 701. The number of frames which should be truncated may be taken from the metadata 414, 424 comprised within the compressed files 413, 423.

The decoding scheme 700 is advantageous over the decoding scheme 600 in that it does not make use of any overlap and add operation 601 in the time-domain, which may add noise to the borders between two succeeding audio tracks 311, 321. Furthermore, the truncating operation 701 can be implemented at reduced computational complexity compared to the overlap and add operation 601.

Figure 8:
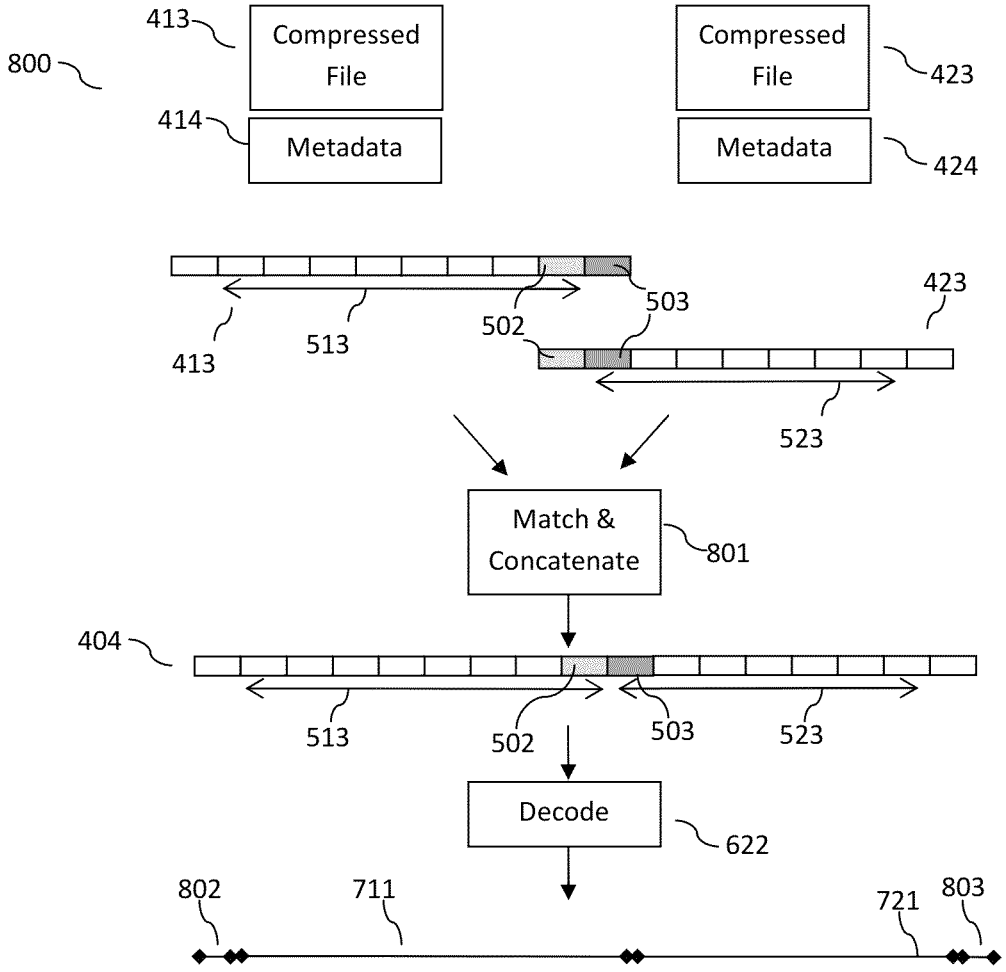
FIG. 8 illustrates an example flowchart of a modified decoding scheme for seamless playback at reduced computational complexity.

On the other hand, it should be noted that in the decoding scheme 700 the redundant compressed frames 502, 503 are decoded twice, i.e. in the first and second instances of the decoding unit 612, 622. FIG. 8 illustrates an alternative decoding scheme 800 which avoids the redundant decoding of the redundant compressed frames 502, 503. For this purpose, the decoding scheme 800 makes use of a matching and concatenating unit 801 which is configured to create a concatenated sequence of compressed frames 404 from the compressed frames comprised within the first and second compressed files 413, 414. The unit 801 may analyze the compressed frames comprised within the first and second compressed files 413, 423 to identify identical compressed frames 502, 503 at their end and beginning, respectively. As such, redundant frames can be removed and a concatenated sequence of non-redundant frames 404 can be generated. Alternatively or in addition, the unit 801 may make use of the metadata 414, 424 comprised within the first and second compressed files 413, 423 to identify the additional compressed frames 502, 503 comprised at the end/beginning of the sequence of compressed files 513, 523, respectively.

The concatenated sequence 404 of compressed frames may then be decoded using a conventional decoding unit 622, thereby yielding a seamless concatenation of decoded audio tracks 711, 721. As such, a seamless playback of the first and second audio track may be provided at reduced computational complexity.

It should be noted that if the first audio track 311 has no further preceding audio track, then the first decoded audio track 711 may be preceded by a lead-in section 802 (e.g. of decoded silence). In a similar manner, if the second audio track 321 has no further succeeding track, then the second decoded audio track 721 may be succeeded by a lead-out section 803 (of decoded silence). In other words, the encoding scheme 400 may be combined with the encoding scheme 300, e.g. in cases where an audio track 311 has no further preceding audio track and/or where an audio track 321 has no further succeeding audio track.

In the present document, methods and systems for encoding/decoding of a sequence of audio tracks are described. In particular, it is proposed to encode an entire uninterrupted sequence of audio tracks as a single file, which is then divided into separate tracks/files in the encoded (i.e., compressed) domain. When dividing the encoded content into a plurality of encoded tracks, some overlap may be included at the beginning and/or end of each encoded track. By way of example, a track may include a pre-determined number of redundant access units (i.e., frames) at the beginning and/or end of the track. In addition to the redundant data, metadata may be included which indicates the amount of overlap data present in successive tracks.

When a decoder is configured in a continuous playback mode and decodes content encoded according to the methods described in the present document, the decoder may interpret the metadata to determine the amount of redundant data (i.e., the number of redundant access units or frames) that should be ignored in order to provide uninterrupted playback of the encoded content. Alternatively, if a user desires instant (i.e., non-sequential) access to any individual track rather than uninterrupted playback, the decoder can skip to the redundant data at the beginning of the desired track and commence decoding at the redundant data, ensuring that by the time the redundant data is processed and the decoder reaches the desired track boundary, the decoder is in the appropriate state to reproduce the audio as intended (i.e. in an undistorted manner).

An application of the methods and systems described in the present document is to provide a so-called "album encode mode" for encoding uninterrupted source content (e.g., a live performance album). When content which is encoded using the "album encode mode" is reproduced by a decoder according to the methods and systems described herein, the user can enjoy the content reproduced as intended (i.e., without interruptions at the track boundaries).

In view of the fact that redundant data is only added in the compressed domain (and possibly removed in the compressed domain), the encoding/decoding can be performed at reduced computational complexity compared to seamless playback schemes which make use of overlap and add operations in the uncompressed domain. Furthermore, the proposed schemes do not add additional noise at the track boundaries.

It should be noted that the description and drawings merely illustrate the principles of the proposed methods and systems. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the proposed methods and systems and the concepts contributed by the inventors to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

Enumerated aspects of the present document are:

Aspect 1) A method for encoding an audio signal comprising a first and a directly following second audio track for seamless and individual playback of the first and second audio tracks; wherein the first and second audio tracks comprise a first and second plurality of audio frames, respectively; the method comprising jointly encoding the audio signal using a frame based audio encoder, thereby yielding a continuous sequence of encoded frames;

extracting a first plurality of encoded frames from the continuous sequence of encoded frames; wherein the first plurality of encoded frames corresponds to the first plurality of audio frames;

extracting a second plurality of encoded frames from the continuous sequence of encoded frames; wherein the second plurality of encoded frames corresponds to the second plurality of audio frames; wherein the second plurality of encoded frames directly follows the first plurality of encoded frames in the continuous sequence of encoded frames;

appending one or more rear extension frames to an end of the first plurality of encoded frames; wherein the one or more rear extension frames correspond to one or more frames from a beginning of the second plurality of encoded frames, thereby yielding a first encoded audio file; and appending one or more front extension frames to the beginning of the second plurality of encoded frames; wherein the one or more front extension frames correspond to one or more frames from the end of the first plurality of encoded frames, thereby yielding a second encoded audio file.

Aspect 2) The method of aspect 1, wherein the number of encoded frames of the first plurality of encoded frames corresponds to the number of frames of the first plurality of audio frames;

each encoded frame of the first plurality of encoded frames comprises encoded data for a single corresponding frame of the first plurality of audio frames;

the number of encoded frames of the second plurality of encoded frames corresponds to the number of frames of the second plurality of audio frames; and each encoded frame of the second plurality of encoded frames comprises encoded data for a single corresponding frame of the second plurality of audio frames.

Aspect 3) The method of aspect 1, wherein there is a one-to-one correspondence between the first plurality of encoded frames and the first plurality of audio frames; and there is a one-to-one correspondence between the second plurality of encoded frames and the second plurality of audio frames.

Aspect 4) The method of aspect 1, wherein the encoded frames of the sequence of encoded frames, of the first encoded audio file and/or of the second encoded audio file have a variable bit length.

Aspect 5) The method of aspect 1, wherein the continuous sequence of encoded frames, the first encoded audio file and/or the second encoded audio file is encoded in an ISO base media file format.

Aspect 6) The method of aspect 1, wherein the continuous sequence of encoded frames, the first encoded audio file and/or the second encoded audio file is encoded in one of the following formats: an MP4 format, 3GP format, 3G2 format, LATM format.

Aspect 7) The method of aspect 1, wherein the frame based audio encoder makes use of an overlapped time-frequency transform overlapping a plurality of audio frames to yield an encoded frame.

Aspect 8) The method of aspect 7, wherein the frame based audio encoder makes use of a Modified Discrete Cosine Transform, a Modified Discrete Sine Transform or a Modified Complex Lapped Transform.

Aspect 9) The method of aspect 7, wherein the frame based audio encoder comprises an advanced audio coding, AAC, encoder.

Aspect 10) The method of aspect 1, further comprising providing metadata indicative of the one or more rear extension frames for the first encoded audio file; and providing metadata indicative of the one or more front extension frames for the second encoded audio file.

Aspect 11) The method of aspect 10, wherein the metadata indicates a number of rear extension frames or a number of front extension frames.

Aspect 12) The method of aspect 10, wherein the metadata is added to the first encoded audio file and comprises an indication of the second encoded audio file as comprising the second audio track directly following the first audio track.

Aspect 13) The method of aspect 10, wherein the metadata is added to the second encoded audio file and comprises an indication of the first encoded audio file as comprising the first audio track directly preceding the second audio track.

Aspect 14) The method of aspect 10, wherein the metadata is added into a metadata container of a file format of the first encoded audio file and/or the second encoded audio file.

Aspect 15) The method of aspect 1, wherein the one or more rear extension frames are two or more, three or more, or four or more rear extension frames; and the one or more front extension frames are two or more, three or more, or four or more front extension frames.

Aspect 16) The method of aspect 1, wherein the one or more rear extension frames are identical to one or more frames from the beginning of the second plurality of encoded frames; and the one or more front extension frames are identical to one or more frames from the end of the first plurality of encoded frames.

Aspect 17) A method for decoding a first and a second encoded audio file, representative of a first and a second audio track, respectively, for seamless playback of the first and second audio track; wherein the first encoded audio track comprises a first plurality of encoded frames followed by one or more rear extension frames; wherein the first plurality of encoded frames corresponds to a first plurality of audio frames of the first audio track; wherein the second encoded audio track comprises a second plurality of encoded frames preceded by one or more front extension frames; wherein the second plurality of encoded frames corresponds to a second plurality of audio frames of the second audio track; the method comprising determining that the one or more rear extension frames correspond to one or more frames from a beginning of the second plurality of encoded frames;

determining that the one or more front extension frames correspond to one or more frames from an end of the first plurality of encoded frames;

concatenating the end of the first plurality of encoded frames with the beginning of the second plurality of encoded frames to form a continuous sequence of encoded frames; and decoding the continuous sequence of encoded frames to yield a joint decoded audio signal comprising the first plurality of audio frames directly followed by the second plurality of audio frames.

Aspect 18) The method of aspect 17 wherein decoding the continuous sequence of encoded frames comprises decoding each encoded frame of the sequence of encoded frames into a single corresponding audio frame of the first or second plurality of audio frames.

Aspect 19) The method of aspect 17, wherein decoding the continuous sequence of encoded frames comprises decoding the sequence of encoded frames into the first and second plurality of audio frames on a frame-by-frame basis.

Aspect 20) The method of aspect 17, wherein determining that the one or more rear extension frames correspond to one or more frames from the beginning of the second plurality of encoded frames comprises extracting metadata associated with the first encoded audio file indicative of a number of rear extension frames; and determining that the one or more front extension frames correspond to one or more frames from the end of the first plurality of encoded frames comprises extracting metadata associated with the second encoded audio file indicative of a number of front extension frames.

Aspect 21) The method of aspect 17, wherein determining that the one or more rear extension frames correspond to one or more frames from the beginning of the second plurality of encoded frames comprises comparing one or more frames at an end of the first encoded audio file with the one or more frames from the beginning of the second plurality of encoded frames; and determining that the one or more front extension frames correspond to one or more frames from the end of the first plurality of encoded frames comprises comparing one or more frames at a beginning of the second encoded audio file with the one or more frames from the end of the first plurality of encoded frames.

Aspect 22) The method of aspect 17 further comprising prior to determining that the one or more front extension frames correspond to one or more frames from the end of the first plurality of encoded frames, identifying the second audio track based on metadata comprised within the first encoded audio track, and/or identifying the first audio track based on metadata comprised within the second encoded audio track.

Aspect 23) An audio encoder configured to encode an audio signal comprising a first and a directly following second audio track for seamless and individual playback of the first and second audio tracks; wherein the first and second audio tracks comprise a first and second plurality of audio frames, respectively; the audio encoder comprising an encoding unit configured to jointly encode the audio signal using a frame based audio encoder, thereby yielding a continuous sequence of encoded frames;

an extraction unit configured to extract a first plurality of encoded frames from the continuous sequence of encoded frames; wherein the first plurality of encoded frames corresponds to the first plurality of audio frames; and configured to extract a second plurality of encoded frames from the continuous sequence of encoded frames; wherein the second plurality of encoded frames corresponds to the second plurality of audio frames; wherein the second plurality of encoded frames directly follows the first plurality of encoded frames in the continuous sequence of encoded frames; and an adding unit configured to append one or more rear extension frames to an end of the first plurality of encoded frames; wherein the one or more rear extension frames correspond to one or more frames from a beginning of the second plurality of encoded frames, thereby yielding a first encoded audio file; and configured to append one or more front extension frames to the beginning of the second plurality of encoded frames; wherein the one or more front extension frames correspond to one or more frames from the end of the first plurality of encoded frames, thereby yielding a second encoded audio file.

Aspect 24) An audio decoder configured to decode a first and a second encoded audio file, representative of a first and a second audio track, respectively, for seamless playback of the first and second audio track; wherein the first encoded audio track comprises a first plurality of encoded frames followed by one or more rear extension frames; wherein the first plurality of encoded frames corresponds to a first plurality of audio frames of the first audio track; wherein the second encoded audio track comprises a second plurality of encoded frames preceded by one or more front extension frames; wherein the second plurality of encoded frames corresponds to a second plurality of audio frames of the second audio track; the audio decoder comprising a detection unit configured to determine that the one or more rear extension frames correspond to one or more frames from a beginning of the second plurality of encoded frames; and configured to determine that the one or more front extension frames correspond to one or more frames from an end of the first plurality of encoded frames;

a merging unit configured to concatenate the end of the first plurality of encoded frames with the beginning of the second plurality of encoded frames to form a continuous sequence of encoded frames; and a decoding unit configured to decode the continuous sequence of encoded frames to yield a joint decoded audio signal comprising the first plurality of audio frames directly followed by the second plurality of audio frames.

Aspect 25) A software program adapted for execution on a processor and for performing the method steps of aspect 1 when carried out on the processor.

Aspect 26) A software program adapted for execution on a processor and for performing the method steps of aspect 17 when carried out on the processor.

Aspect 27) A storage medium comprising a software program adapted for execution on a processor and for performing the method steps of aspect 1 when carried out on a computing device.

Aspect 28) A storage medium comprising a software program adapted for execution on a processor and for performing the method steps of aspect 17 when carried out on a computing device.

Aspect 29) A computer program product comprising executable instructions for performing the method steps of aspect 1 when executed on a computer.

Aspect 30) A computer program product comprising executable instructions for performing the method steps of aspect 17 when executed on a computer.

The invention claimed is:

1. A method for encoding an audio signal comprising a first and a directly following second audio track for seamless and individual playback of the first and second audio tracks; wherein the first and second audio tracks comprise a first and second plurality of audio frames, respectively; the method comprising jointly encoding the audio signal using a frame based audio encoder, thereby yielding a continuous sequence of encoded frames;

extracting a first plurality of encoded frames from the continuous sequence of encoded frames; wherein the first plurality of encoded frames corresponds to the first plurality of audio frames;

extracting a second plurality of encoded frames from the continuous sequence of encoded frames; wherein the second plurality of encoded frames corresponds to the second plurality of audio frames; wherein the second plurality of encoded frames directly follows the first plurality of encoded frames in the continuous sequence of encoded frames;

appending one or more rear extension frames to an end of the first plurality of encoded frames; wherein the one or more rear extension frames correspond to one or more frames from a beginning of the second plurality of encoded frames, thereby yielding a first encoded audio file; and appending one or more front extension frames to the beginning of the second plurality of encoded frames; wherein the one or more front extension frames correspond to one or more frames from the end of the first plurality of encoded frames, thereby yielding a second encoded audio file.

2. The method of claim 1, wherein the number of encoded frames of the first plurality of encoded frames corresponds to the number of frames of the first plurality of audio frames;

each encoded frame of the first plurality of encoded frames comprises encoded data for a single corresponding frame of the first plurality of audio frames;

the number of encoded frames of the second plurality of encoded frames corresponds to the number of frames of the second plurality of audio frames; and each encoded frame of the second plurality of encoded frames comprises encoded data for a single corresponding frame of the second plurality of audio frames.

3. The method of claim 1, wherein there is a one-to-one correspondence between the first plurality of encoded frames and the first plurality of audio frames; and there is a one-to-one correspondence between the second plurality of encoded frames and the second plurality of audio frames.

4. The method of claim 1, wherein the encoded frames of the sequence of encoded frames, of the first encoded audio file and/or of the second encoded audio file have a variable bit length.

5. The method of claim 1, wherein the frame based audio encoder makes use of an overlapped time-frequency transform overlapping a plurality of audio frames to yield an encoded frame.

6. The method of claim 1, further comprising providing metadata indicative of the one or more rear extension frames for the first encoded audio file; and providing metadata indicative of the one or more front extension frames for the second encoded audio file.

7. The method of claim 6, wherein the metadata indicates a number of rear extension frames or a number of front extension frames.

8. The method of claim 6, wherein the metadata is added to the first encoded audio file and comprises an indication of the second encoded audio file as comprising the second audio track directly following the first audio track.

9. The method of claim 6, wherein the metadata is added to the second encoded audio file and comprises an indication of the first encoded audio file as comprising the first audio track directly preceding the second audio track.

10. The method of claim 6, wherein the metadata is added into a metadata container of a file format of the first encoded audio file and/or the second encoded audio file.

11. The method of claim 1, wherein the one or more rear extension frames are two or more, three or more, or four or more rear extension frames; and the one or more front extension frames are two or more, three or more, or four or more front extension frames.

12. The method of claim 1, wherein the one or more rear extension frames are identical to one or more frames from the beginning of the second plurality of encoded frames; and the one or more front extension frames are identical to one or more frames from the end of the first plurality of encoded frames.

13. A method for decoding a first and a second encoded audio file, representative of a first and a second audio track, respectively, for seamless playback of the first and second audio track; wherein the first encoded audio track comprises a first plurality of encoded frames followed by one or more rear extension frames; wherein the first plurality of encoded frames corresponds to a first plurality of audio frames of the first audio track; wherein the second encoded audio track comprises a second plurality of encoded frames preceded by one or more front extension frames; wherein the second plurality of encoded frames corresponds to a second plurality of audio frames of the second audio track; the method comprising determining that the one or more rear extension frames correspond to one or more frames from a beginning of the second plurality of encoded frames;

determining that the one or more front extension frames correspond to one or more frames from an end of the first plurality of encoded frames;

concatenating the end of the first plurality of encoded frames with the beginning of the second plurality of encoded frames to form a continuous sequence of encoded frames; and decoding the continuous sequence of encoded frames to yield a joint decoded audio signal comprising the first plurality of audio frames directly followed by the second plurality of audio frames.

14. The method of claim 13, wherein decoding the continuous sequence of encoded frames comprises decoding each encoded frame of the sequence of encoded frames into a single corresponding audio frame of the first or second plurality of audio frames.

15. The method of claim 13, wherein decoding the continuous sequence of encoded frames comprises decoding the sequence of encoded frames into the first and second plurality of audio frames on a frame-by-frame basis.

16. The method of claim 13, wherein determining that the one or more rear extension frames correspond to one or more frames from the beginning of the second plurality of encoded frames comprises extracting metadata associated with the first encoded audio file indicative of a number of rear extension frames; and determining that the one or more front extension frames correspond to one or more frames from the end of the first plurality of encoded frames comprises extracting metadata associated with the second encoded audio file indicative of a number of front extension frames.

17. The method of claim 13, wherein determining that the one or more rear extension frames correspond to one or more frames from the beginning of the second plurality of encoded frames comprises comparing one or more frames at an end of the first encoded audio file with the one or more frames from the beginning of the second plurality of encoded frames; and determining that the one or more front extension frames correspond to one or more frames from the end of the first plurality of encoded frames comprises comparing one or more frames at a beginning of the second encoded audio file with the one or more frames from the end of the first plurality of encoded frames.

18. The method of claim 13 further comprising prior to determining that the one or more front extension frames correspond to one or more frames from the end of the first plurality of encoded frames, identifying the second audio track based on metadata comprised within the first encoded audio track, and/or identifying the first audio track based on metadata comprised within the second encoded audio track.

19. An audio encoder configured to encode an audio signal comprising a first and a directly following second audio track for seamless and individual playback of the first and second audio tracks; wherein the first and second audio tracks comprise a first and second plurality of audio frames, respectively; the audio encoder comprising an encoding unit configured to jointly encode the audio signal using a frame based audio encoder, thereby yielding a continuous sequence of encoded frames;

an extraction unit configured to extract a first plurality of encoded frames from the continuous sequence of encoded frames; wherein the first plurality of encoded frames corresponds to the first plurality of audio frames; and configured to extract a second plurality of encoded frames from the continuous sequence of encoded frames; wherein the second plurality of encoded frames corresponds to the second plurality of audio frames; wherein the second plurality of encoded frames directly follows the first plurality of encoded frames in the continuous sequence of encoded frames; and an adding unit configured to append one or more rear extension frames to an end of the first plurality of encoded frames; wherein the one or more rear extension frames correspond to one or more frames from a beginning of the second plurality of encoded frames, thereby yielding a first encoded audio file; and configured to append one or more front extension frames to the beginning of the second plurality of encoded frames; wherein the one or more front extension frames correspond to one or more frames from the end of the first plurality of encoded frames, thereby yielding a second encoded audio file.

20. An audio decoder configured to decode a first and a second encoded audio file, representative of a first and a second audio track, respectively, for seamless playback of the first and second audio track; wherein the first encoded audio track comprises a first plurality of encoded frames followed by one or more rear extension frames; wherein the first plurality of encoded frames corresponds to a first plurality of audio frames of the first audio track; wherein the second encoded audio track comprises a second plurality of encoded frames preceded by one or more front extension frames; wherein the second plurality of encoded frames corresponds to a second plurality of audio frames of the second audio track; the audio decoder comprising a detection unit configured to determine that the one or more rear extension frames correspond to one or more frames from a beginning of the second plurality of encoded frames; and configured to determine that the one or more front extension frames correspond to one or more frames from an end of the first plurality of encoded frames;

a merging unit configured to concatenate the end of the first plurality of encoded frames with the beginning of the second plurality of encoded frames to form a continuous sequence of encoded frames; and a decoding unit configured to decode the continuous sequence of encoded frames to yield a joint decoded audio signal comprising the first plurality of audio frames directly followed by the second plurality of audio frames.

* * * * *